US011780538B2

(12) United States Patent
Werner

(10) Patent No.: US 11,780,538 B2
(45) Date of Patent: Oct. 10, 2023

(54) ELECTRIC MOTORISED WATERCRAFT AND DRIVELINE SYSTEM

(71) Applicant: RIDE AWAKE AB, Limhamn (SE)

(72) Inventor: Philip Werner, Malmö (SE)

(73) Assignee: Ride Awake AB, Limhamn (SE)

( * ) Notice: Subject to any disclaimer, the term of this patent is extended or adjusted under 35 U.S.C. 154(b) by 0 days.

(21) Appl. No.: 17/834,374

(22) Filed: Jun. 7, 2022

(65) Prior Publication Data

US 2022/0306248 A1 Sep. 29, 2022

Related U.S. Application Data

(63) Continuation of application No. 16/957,694, filed as application No. PCT/EP2018/086494 on Dec. 21, 2018, now Pat. No. 11,383,797.

(30) Foreign Application Priority Data

Dec. 27, 2017 (SE) ..... 1751655-0
Sep. 7, 2018 (SE) ..... 1851065-1

(51) Int. Cl.

| | |
|---|---|
| ***B63B 32/10*** | (2020.01) |
| ***B63B 32/53*** | (2020.01) |
| ***B63H 11/08*** | (2006.01) |
| ***B63H 21/17*** | (2006.01) |
| ***B63B 1/24*** | (2020.01) |

(52) U.S. Cl.

CPC ..... *B63B 32/10* (2020.02); *B63B 32/53* (2020.02); *B63H 11/08* (2013.01); *B63H 21/17* (2013.01); *B63B 1/24* (2013.01); *B63B 1/246* (2013.01)

(58) Field of Classification Search

CPC ..... B63B 32/10; B63B 32/53; B63B 1/24; B63B 1/246; B63H 11/08; B63H 21/17

See application file for complete search history.

(56) References Cited

U.S. PATENT DOCUMENTS

| | | | |
|---|---|---|---|
| 2,434,700 | A | 1/1948 | Keckley |
| 2,440,345 | A | 4/1948 | Neel |
| 3,405,677 | A | 10/1968 | Smith |
| 3,406,653 | A | 10/1968 | Mela |
| 3,536,025 | A | 10/1970 | Tierney et al. |
| 3,548,778 | A | 12/1970 | Smagala-Romanoff |
| 3,608,512 | A | 9/1971 | Thompson |
| D289,031 | S | 3/1987 | Monostory |
| 4,894,034 | A | 1/1990 | Brown, III |
| 5,184,563 | A | 2/1993 | Hislop |
| 5,306,188 | A | 4/1994 | Skedeleski et al. |

(Continued)

FOREIGN PATENT DOCUMENTS

| | | |
|---|---|---|
| CA | 2425484 | 10/2003 |
| CN | 201012743 Y | 1/2008 |

(Continued)

OTHER PUBLICATIONS

Vermillion, EM 005331774-0002 filed Jun. 29, 2018, in the EUIPO, in the name of Phiwer Sports AB.

(Continued)

*Primary Examiner* — Stephen P Avila
(74) *Attorney, Agent, or Firm* — Capitol City TechLaw

(57) ABSTRACT

An electrically motorized watercraft may include a hull module and a driveline system. The driveline system may include an electric power module and a driveline module. The driveline module may be arranged at an underside of the hull module.

17 Claims, 13 Drawing Sheets

(56) References Cited

U.S. PATENT DOCUMENTS

| | | | |
|---|---|---|---|
| 5,582,529 | A | 12/1996 | Montgomery |
| 5,839,384 | A | 11/1998 | Burg |
| D410,515 | S | 6/1999 | Alexander |
| 6,192,817 | B1 | 2/2001 | Dec et al. |
| D446,273 | S | 8/2001 | Natale |
| 6,796,858 | B2 | 9/2004 | Dusablon et al. |
| 7,074,098 | B1 | 7/2006 | Acosta, Jr. |
| 7,175,481 | B1 | 2/2007 | Cotton et al. |
| 7,930,985 | B2 | 4/2011 | Walworth et al. |
| 8,342,114 | B2 | 1/2013 | Goubault et al. |
| 8,398,446 | B2 | 3/2013 | Railey et al. |
| 8,702,458 | B2 | 4/2014 | Preston |
| 8,951,079 | B2 | 2/2015 | Railey et al. |
| 9,359,044 | B2 | 6/2016 | Langelaan |
| 9,387,908 | B1 | 7/2016 | Paulino |
| 10,011,329 | B1 | 7/2018 | Cooper |
| 10,035,570 | B1 | 7/2018 | Barron |
| 10,118,677 | B2 | 11/2018 | Zapata |
| 10,150,544 | B2 | 12/2018 | Schibli |
| D847,927 | S | 5/2019 | Duff |
| 10,518,842 | B1 | 12/2019 | Kyle et al. |
| D882,010 | S | 4/2020 | Vermillion |
| 10,647,392 | B2 | 5/2020 | Trewern |
| 11,383,797 | B2 | 7/2022 | Werner |
| 2002/0077007 | A1 | 6/2002 | Dagenais et al. |
| 2002/0162498 | A1 | 11/2002 | Robinson et al. |
| 2006/0254495 | A1 | 11/2006 | Eckert |
| 2007/0190840 | A1 | 8/2007 | Hanada et al. |
| 2007/0293087 | A1 | 12/2007 | Kennedy et al. |
| 2009/0165696 | A1 | 7/2009 | Burroughs |
| 2009/0249991 | A1 | 10/2009 | McGeever et al. |
| 2011/0201238 | A1 | 8/2011 | Rott et al. |
| 2013/0059489 | A1 | 3/2013 | Vlock et al. |
| 2013/0157526 | A1 | 6/2013 | Martin |
| 2014/0287283 | A1 | 9/2014 | Kimpara et al. |
| 2015/0104985 | A1 | 4/2015 | Langelaan |
| 2016/0207591 | A1 | 7/2016 | Loui et al. |
| 2016/0347428 | A1 | 12/2016 | Mahar |
| 2017/0007934 | A1 | 1/2017 | Hohns et al. |
| 2017/0283015 | A1 | 10/2017 | Lengelaan |
| 2018/0072383 | A1 | 3/2018 | Montague et al. |
| 2018/0170502 | A1 | 6/2018 | Terada |
| 2019/0168851 | A1 | 6/2019 | Tian |
| 2019/0173138 | A1 | 6/2019 | Tian |
| 2021/0024178 | A1 | 1/2021 | Weisenburger |
| 2021/0114695 | A1 | 4/2021 | Weisenburger et al. |
| 2021/0276669 | A1 | 9/2021 | Lyon et al. |
| 2021/0347441 | A1 | 11/2021 | Lyon et al. |
| 2021/0371053 | A1 | 12/2021 | Werner |

FOREIGN PATENT DOCUMENTS

| | | | |
|---|---|---|---|
| CN | 102951256 | A | 3/2013 |
| CN | 205738032 | U | 11/2016 |
| CN | 110844006 | A | 2/2020 |
| CN | 111370912 | A | 7/2020 |
| CN | 111509477 | A | 8/2020 |
| DE | 4430775 | A1 | 3/1996 |
| DE | 102013218735 | A1 | 3/2015 |
| DE | 202017103703 | U1 | 7/2017 |
| DE | 202015009474 | U1 | 10/2017 |
| EP | 1107903 | B1 | 6/2001 |
| EP | 3552947 | A1 | 10/2019 |
| EP | 3569487 | A1 | 11/2019 |
| EP | 3611092 | A1 | 2/2020 |
| EP | 3629425 | A1 | 4/2020 |
| FR | 3078680 | A1 | 9/2019 |
| GB | 498214 | A | 1/1939 |
| GB | 1406161 | | 9/1975 |
| JP | H06171583 | A | 6/1994 |
| JP | 2002193185 | A | 7/2002 |
| KR | 20120003196 | U | 5/2012 |
| KR | 101767476 | B1 | 11/2017 |
| KR | 1020190131811 | A | 11/2019 |
| KR | 102103228 | B1 | 4/2020 |
| WO | 1999057006 | | 11/1999 |
| WO | 2014145601 | A2 | 9/2014 |
| WO | 2015039970 | A1 | 3/2015 |
| WO | 2016061274 | A1 | 4/2016 |
| WO | WO2016061274 | A1 | 4/2016 |
| WO | 2016144852 | A1 | 9/2016 |
| WO | 2016193382 | A1 | 12/2016 |
| WO | 2017069322 | A1 | 4/2017 |
| WO | 2019129687 | A1 | 7/2019 |
| WO | 2019141799 | A1 | 7/2019 |
| WO | 2019143276 | A1 | 7/2019 |
| WO | 2020242146 | A1 | 12/2020 |

OTHER PUBLICATIONS

Werner et al., EM 007473020-0001 filed Jan. 3, 2020, in the EUIPO, in the name of Ride Awake AB.

Werner et al., Design U.S. Appl. No. 29/740,288, filed Jul. 2, 2020, in the name of Ride Awake AB.

ELECTRIC MOTORISED WATERCRAFT AND DRIVELINE SYSTEM

This application is a continuation application of U.S. patent application Ser. No. 16/957,694 filed on Jun. 24, 2020, which is a US National Phase Application of International Application No. PCT/EP2018/086494 filed on Dec. 21, 2018, the entire contents of both of which are incorporated herein by reference.

This application claims priority under 35 USC 119(a)-(d) from SE Patent Application No. 1751655-0 filed on Dec. 27, 2017, and SE Patent Application No. 1851065-1 filed on Sep. 7, 2018, the entire contents of both of which are incorporated herein by reference.

TECHNICAL FIELD

The present invention relates to watercrafts. In particular the invention relates to an electrical motor driven watercraft system and a driveline system, more in particular a modular electric motor driven watercraft system and a modular driveline system.

BACKGROUND

There are only a small amount of existing electrical watercrafts on the market. There exists different solutions on how the motor is mounted on the watercraft. Some are integrated some are detachable. Furthermore, there exists different setups with integrated or detachable batteries.

SUMMARY

An object of the present invention is to provide a simple watercraft solution which enables a higher level of modularity than existing solutions.

It is a further object of the present disclosure to provide a driveline module which facilitates improved efficiency and improved maneuverability of a watercraft.

These objects and further objects, which will appear from the following description, have now been achieved by the technique set forth in the appended independent claims; preferred embodiments being defined in the related dependent claims.

In a first aspect of the present invention there is provided a simple modular solution where the driveline, hull and electronics are independent parts. The driveline module may comprise two sub-modules. The hull is only a dead body, hence, the electric and the propulsion system can work together externally and can be used on different types of bodies. This vastly facilitates the assembly and maintenance of the watercraft. It also enables the possibility to easily customize the watercraft with different size of hull, propulsions, batteries and motors.

The driveline unit or module can also be fitted with hydrofoil wings and raised up over the water to enable the watercraft to ride over the water and therefore enable less drag in the water and therefore decreasing the energy-consumption of the watercraft and also increasing the speed of the craft.

The present invention solves the problems with the known technical solutions by its unique characteristics stated in the claims below. The invention enables a higher level of modularity than existing solutions.

The present invention may comprise three major parts, a hull module, an electronics box (herein also referred to as the power module) and a driveline module. The hull is designed with very low complexity so that the manufacturing process only includes the production of a solid body. The hull does not have any waterproof compartments for electronics, motors, gasoline or similar.

The electronics box, is the energy source wherein most of the electronics are installed. This includes battery cells, computer, battery management system, switches etc. The composition of electronics can vary. The box can be designed in any material.

The electronics box can be constructed with or without an active cooling system. This means that the box can include a mechanical cooling system as well as be cooled off by natural convection.

The motor is installed in a waterproof container or casing. The motor is located underneath the watercraft. It may be connected by an axis to the propelling member. The motor can be constructed with or without an active cooling system. This means that the motor can include a mechanical cooling system as well as be cooled off by natural convection.

The system could be used for any type of watercraft, for example it could be used for hydrofoiling watercrafts, electric powered surfboards, jetski/water scooters, over water drones, underwater drones, underwater crafts, underwater personal craft, submarines and boats.

The watercraft may be manufactured by combining three independent sub-assemblies in the form of modules (hull, driveline, battery pack) to one fully functional watercraft and is thus based on modularity. Thereby, different hulls can be used with same driveline module. The invention's hull may consist of one solid body. The three main parts can be manufactured and assembled separately which facilitated maintenance and service. Also, the different parts can be maintained and serviced separately. Aspects of the invention achieves that no electrical parts are integrated in the hull. The battery may connect directly to the driveline module by a waterproof blind mate connector. The driveline may comprise one or more electrical motors.

The battery could be activated when connected to the driveline additional activators for example magnets that is read by hall-sensors inside of the battery could be placed in the hull as well. The electronics box could or could not include an electric speed controller. The driveline could or could not include an electric speed controller. In case the sub-assembly which constitutes the independent driveline module includes an electric speed controller (ESC), the ESC may be provided in the form of a sub-module of the driveline module. Thus, the driveline module may comprise two sub-modules. The two sub-modules may be connected for example by means of a watertight connection which may comprise a watertight plug-socket arrangement.

The driveline module connects to the power module by means of a single connection means such as a watertight plug-socket arrangement, and which is adapted to transfer both data and power.

The electronics box may have active or passive cooling by the surrounding water or air. The driveline unit can have active or passive cooling by the surrounding water or air. The driveline may be fitted with hydrofoil wings and struts to enable enabling a foiling ride of the watercraft.

In a second aspect of the invention, there is provided a modular electrically motorized watercraft, the watercraft comprising a hull module, an electric power module and a driveline module; wherein the hull module is independently waterproof, and wherein the electric power module and the driveline module are respectively adapted to be mechanically detachably attached to the hull module and respectively adapted to form direct electric and direct mechanical connection with each other. In a third aspect the watercraft consists of said hull module, the electric power module and the driveline module.

In a fourth aspect, there is provided a modular electrically motorized watercraft, the watercraft comprising a hull module and a driveline system. The driveline system comprising an electric power module and a driveline module. The driveline module may be configured to be arranged on or at an underside of the hull module.

Embodiments of the above aspects will now be further elucidated.

In a one embodiment the driveline module extends from a lower external side of the hull module.

The driveline module may be submerged in a surrounding fluid during operation of said watercraft.

In one embodiment the driveline module is detachably attached to an external side of the hull module.

The electric power module may be detachably attached an external side of the hull module and forms an external side of the watercraft.

The electric power module and the driveline module may be detachably attached on adjacent sides of the hull module.

In one embodiment the driveline module comprises a motor in driving connection with a propelling member by means of a drive axle, the propelling member disposed at a rear end of the watercraft and the motor being disposed with an axial distance apart from the propelling member.

The motor and the propelling member may be separated by a gap and the drive axle extends over the gap.

In one embodiment the gap has a length k, the length adapted to allow for water to enter the propelling member in a direction substantially parallel the drive axle during operation of the watercraft.

The driveline module and the electrical power module may form a propulsion system capable of operating independently the hull module.

In one embodiment the hull module comprises a through hole extending from an upper side of the hull module to a lower side of the hull module.

The hull module may be waterproof.

In one embodiment an external side of the hull module is configured to receive the electric power module, preferably the hull module comprises a compartment adapted to slidably receive the electric power module.

The watercraft may be a personal transportation and/or leisure and/or sports watercraft.

In one embodiment the driveline module comprises a hull connection for mechanical connection to an external side of the hull module.

A necessary all electrical components may be integrated in the driveline system.

In one embodiment the electrical power module connects directly to the driveline module by a waterproof blind mate connector.

The driveline module may have more than one electrical motor.

In one embodiment the electric power module is activated when connected to the driveline module by magnets that is read by hall-sensors.

The electric power module and/or the driveline module may comprise a speed controller.

In one embodiment the watercraft is controlled by means of remote control.

The driveline module may comprise hydrofoil wings and struts to enable a foiling ride of said watercraft.

In one aspect the invention relates to a hull module for use in the watercraft according to any one of the aspects.

In one aspect the invention relates to a driveline module for use in the watercraft according to any one of the aspects.

In one aspect the invention relates to an electric power module for use in the watercraft according to any one of the aspects.

In one embodiment the hull module may be waterproof and not buoyant during operation in water, for example if the watercraft is an underwater personal craft.

The hull module, the electric power module and the driveline module may each be individually waterproof.

The driveline module may operate externally the hull module during operation of the watercraft. The driveline module may be capable of operation independently the hull module. The driveline system may be capable of driving an electric motor independently of the hull module. The hull module may be independently waterproof.

The electric power module and the driveline module may be respectively configured to establish electric connection with each other and releasable mechanical connection with each other.

Each of the electric power module and/or the driveline module may comprise respective electric connection means and releasable mechanical connection means for connecting to each other. The electric connection means and/or the releasable mechanical connection means may be disposed externally the hull module of the watercraft.

The electric connection means and/or said releasable mechanical connection means may be disposed in the compartment of the watercraft. The mechanical connection may comprise a watertight connection. The mechanical connection may comprise a watertight connection disposed inside the through hole or in the compartment.

The mechanical connection may physically and sealingly connect and hold the electric power module and the driveline module together.

The electric connection means and releasable mechanical connection means may comprise a waterproof blind-mate connection configured to connect the power module to the driveline module simultaneously as the power module is received in the compartment.

The connection means are arranged on the electric speed controller of the driveline module.

In one embodiment, the power module connected to the hull module and to the driveline module simultaneously.

The power module may be configured to simultaneously connect mechanically to the hull module and mechanically and electrically to the driveline module.

The power module may be configured to be mounted on a side of said watercraft which is opposite the driveline module.

A hull module is disclosed herein. In a one aspect the invention relates to a hull module, in particular for a watercraft according to any one of the aspects.

The hull module may be absent any waterproof compartments for electronics, motors, gasoline or similar.

The hull module may be configured to receive said electric power module.

The hull module and/or the electric power module and/or the driveline module may be individually waterproof. The motor is installed in a waterproof container or casing of the driveline module.

The hull module is an empty shell-type hull, independently waterproof or hermetically sealed. An external surface, preferably an upper surface of the hull module may comprise a shelf-like compartment configured to receive and retain the electric power module.

In one embodiment, no electrical parts are integrated in the hull module. The power module comprises battery cells, a computer, battery management system, switches.

The longitudinal axis of the depression may be substantially parallel the longitudinal axis of the driveline module. The depression may envelope substantially an upper semi-cylindrical a portion of the driveline module comprising a motor casing.

The depression may envelope substantially half of a pod of the driveline module which houses the impeller. The depression may comprise a semi-circular/semi-cylindrical shape.

A surface of the hull module adjacent the depression may comprise evened out edges to form a smooth transition between the surface of the hull module and the depression.

An underside of the hull module may comprise an elongated recess or depression extending in the longitudinal direction of said hull module and configured to receive the driveline module.

An external side of said hull module may form a compartment configured to receive the electric power module.

The compartment may open to the ambient/constitutes a depression in the hull module which is open to ambient elements. The compartment does not comprise a closed compartment.

The compartment may be configured to provide passive water cooling to the power module when the power module is received in the compartment.

The compartment may be configured to allow water to flow therein when the power module is received therein to thereby at least partially submerge the power module.

Cooling water that flow into the compartment may be allowed drain through the hull module via the through hole. Hence, the through hole may be arranged to drain cooling water that flow into the compartment through the hull module.

The hull module may comprise at least one through-hole extending through the hull module.

The through hole may be adapted to receive a connector of the driveline module.

The through hole may extend from the upper surface of the hull module to the bottom surface of the hull module. The through hole may provide an opening for mechanical and electrical connection there through between the electric power module and the driveline module.

An inner surface of the through hole may constitute an external surface of the hull module such that no water is allowed to enter the hull module.

The electric power module and the driveline module may connect electrically and mechanically via the through hole.

The through hole may be formed removed from the edges of said hull module, preferably substantially at a transversally centered position. The through hole may fluidly connect an upper side to a lower side of said hull module.

The through hole may comprise a circumferential rim. The hull module may extend continuously around/about the through hole. The electric power module and the driveline module may connect electrically and mechanically externally the hull module.

The electric power module and/or the driveline module may at least partially extend into the through hole. The through hole opens to and/or is in communication with the compartment.

The electric power module and/or the driveline module may at least partially extend into the through hole. The driveline module may extend into the compartment.

The through hole provides a passage for cooling water through the hull module.

Water accumulated in the compartment may be is drained via the through hole to provide passive cooling to the driveline module.

The driveline system may be capable of operating independently the hull module.

The power module and driveline module may each be individually waterproof.

The modules may be individual parts. Substantially the entire driveline module may be submerged in a surrounding fluid during operation of the watercraft. The modules may constitute independent sub-assemblies in the form of modules which can be assembled to a fully functional watercraft. No electrical parts may be integrated in the hull module.

In one aspect, there is provided a driveline system, in particular for a hull module of a watercraft, such as disclosed herein. The driveline system comprises a power module and a driveline module. The driveline module is configured to be mounted at an underside of a hull module of the watercraft. The driveline system may be independently waterproof and may be capable of operating independently. The power module and driveline module may be configured to work together externally the hull module.

One or more of the modules may be independent sub-assemblies and/or independent parts where each independent sub-assembly has its individual housing.

An electric power module is disclosed herein. In one aspect the invention relates to an electric power module, in particular for a watercraft according to any one of the aspects.

All necessary electrical components may be integrated in the driveline system.

The electric power module may be detachably attached an external side of the hull module and form an external side of the watercraft. The electric power module and the driveline module may be detachably attached on opposite sides of said hull module.

A driveline module is disclosed herein. In one aspect the invention relates to a driveline module, in particular for a watercraft according to any one of the aspects.

The driveline module according to the disclosure facilitates improved efficiency and improved maneuverability of a watercraft.

In one aspect there is provided a driveline module.

The driveline module may comprise at least one motor in driving connection with a respective propelling member by means of a drive axle. The propelling member may be arranged on the drive axle. The propelling member may be disposed at a rear end of the watercraft. The motor may be disposed with an axial distance apart from the propelling member. The driveline module comprises a casing or pod surrounding the propelling member.

The driveline module may comprise an electronic speed controller (ESC) configured to be arranged underneath the watercraft. The driveline module may comprise an electronic speed controller (ESC) configured to be arranged underneath the watercraft directly beneath a through hole of the watercraft.

The driveline module may comprise a water jet arrangement, as will be explained herein.

The driveline module may comprise an impeller, a stator, a nozzle arranged in this successive order to form a water jet arrangement and optional inlet guide vanes arranged upstream the impeller. The diameter of the pod may be greater than the diameter of the motor casing. The driveline system may have an electric speed controller (ESC) which constitutes a sub-module of the driveline module.

The casing or pod and the motor are respectively attached to a hull connection which fixates the positions of the pod and the motor.

The pod and the motor unit are not in direct contact with each other. The motor and the propelling member are separated by a gap having the length k.

The propelling member may be in the form of an impeller and the pod may comprise a stator downstream the impeller, the pod may form a nozzle portion downstream the stator. The connector means of the driveline module may be received in the power module.

The driveline module may comprise hydrofoil wings and struts to enable a foiling ride of the watercraft.

Prior art water jet-arrangements typically suffer from drawbacks in terms of efficiency and maneuverability. When a water-jet arrangement is provided inside of a hull module, such as to commonly known jet-ski, the configuration necessitates that the water to be ingested by the impeller is diverted from a direction parallel the direction of the watercraft and upwards into a tunnel or conduit formed inside the hull, and subsequently diverted to flow in a direction parallel the direction of the watercraft prior being ingested by the impeller and subsequently ejected. Although it is typically advantageous in terms of efficiency to provide a straight fluid flow prior the impeller, this configuration has the drawbacks that the diversions i.e. deflections of the water flow reduces the efficiency of the water jet. Further, the driving motor has to be arranged inside the hull module since it cannot be arranged in the tunnel. On the other hand, a jet-ski can be provided with a hydrodynamic bottom surface, which is advantageous in terms of energy losses.

Some propulsion modules can be mounted externally a hull module of a watercraft and are thus not typically associated with the above mentioned problems. However, such configurations brings about apparent drawbacks in terms of hydrodynamic properties due to the propulsion module protruding beneath the hull. Additionally, the inventor of the present invention have realized that this configuration impairs the maneuverability of the watercraft, in particular if installed on a hull module in the form of a board. The inventor have employed a number of inventive features in order to overcome or at least mitigate the above mentioned problems. Firstly, the driveline module according to aspects of the disclosure is configured to be mounted close to the hull module, preferably the driveline module is configured to be at least partially received in the hull module, as will be explained herein. Secondly, the impeller is separated from the motor by a water-filled gap which provides a space for the water to be ingested by the impeller to naturally and unforced assume a flow direction which is parallel the velocity direction of the board and/or parallel the direction of the flow through the pod which houses the impeller. This is possible since only the drive axle extends through the gap. In order to facilitate the gap, the motor casing and the pod are not in contact with each other but are mounted independently to a mounting track/rail or hull connection, alternatively mounted independently to the hull module. The independent mounting facilitates that the both the motor and the pod is rigidly attached in their respective positions and can thus withstand forces without dislodging or pivoting. A further feature includes that a portion of the motor casing or driveline module upstream and adjacent the gap is provided with a conical shape, with the drive axle protruding from the tip thereof. The conical shape provides a hydrodynamic shape and facilitates the water to be ingested to assume the said parallel flow direction without causing turbulence and other losses due to deflection, sharp edges etc. The length of the subsequent gap between the conical-shape and the pod may correspond approximately the longitudinal length of the conical-shape.

The disclosed gap is also configured to cooperate with the hull module. In particular, the gap is configured to cooperate with a cavity formed in the hull module. The cavity is preferably provided in the hull module adjacent the gap, in particular the cavity may be provided below a waterline of the watercraft. Thereby, water to be ingested by the impeller will flow into the cavity naturally. In particular, the cavity facilitates that an area greater than the inlet of the pod is absent of obstacles upstream the pod. This configuration facilitates that greater flows of water can enter the pod without causing increased losses. The cavity will be further explained herein.

In one aspect the invention relates to a method of assembling a modular electric motorized watercraft, the electric motorized watercraft comprising a hull module, a driveline module and a power source module, the method comprising the steps of receiving a requirement relating to a desired functionality of the watercraft; selecting a hull module from the group comprising or consisting of; hydrofoiling watercraft, surfboard, jetski/water scooter, over water drone, underwater drone, underwater craft, underwater personal craft, submarine, boat; selecting a driveline module; detachably attaching the driveline module to the hull module; selecting a power source module; detachably attaching the power source module to the hull module; connecting the selected power source module to the selected driveline module.

The above embodiments are by not to be construed as limiting the invention, rather, embodiments and aspects may be combined to yield yet further embodiments.

Further advantages and aspects are described below and set forth in the appended claims.

BRIEF DESCRIPTION OF DRAWINGS

Embodiments of the invention will be described in further detail below in the shape of non-limiting examples and with reference to the accompanying drawings, in which.

DETAILED DESCRIPTION

The invention will now be explained with reference to the accompanying drawings.

Figure 1:
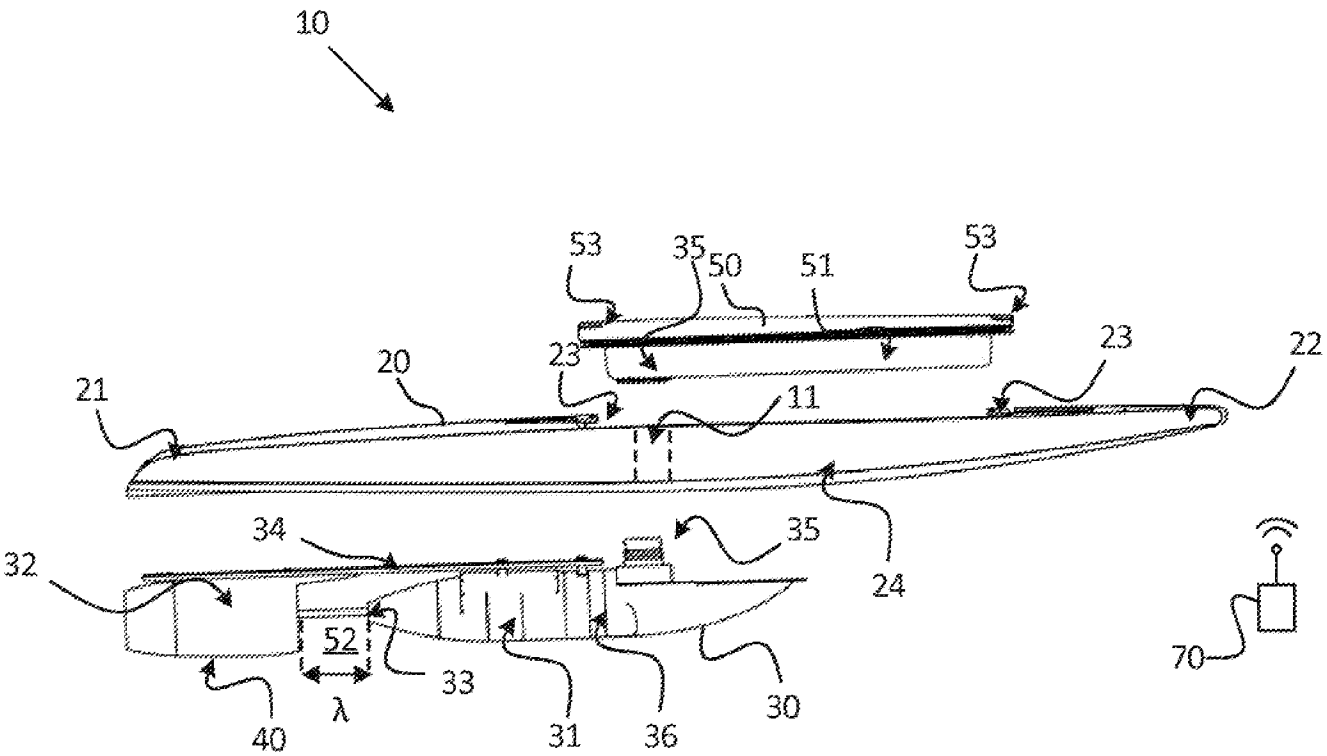
FIG. 1 shows a perspective side view of the watercraft according to an embodiment of the invention.

FIG. 1 shows a watercraft 10 according to one embodiment of the invention wherein the hull module 20 of the watercraft 10 is in the form of a board. According to general aspects the hull module 20 is fluid tight or waterproof. In this particular embodiment the board itself is also buoyant on its own merit and may comprise an empty shell-type hull. The hull module 20 has a front end 22 and a rear end 21 with the hull extending there between.

The hull module 20 comprises means for receiving the electric power module 50 here in the form of a shelf-like compartment 24 facilitating that an electric power module 50 is safely received and retained in the hull module 20 without risk of dislodging during operation of the watercraft 10. The electric power module 50 may comprise a shape corresponding to an external surface, such as the top-part of the hull module and thus become flush with edges of the hull module 20 and/or compartment 24 upon attachment to the hull module 20/compartment 24. Attachment means 23, 53 may be provided in the hull module 20 and/or on the electric power module 50 for detachable attachment of the electric power module 50 to the hull module 20. The attachment means 23, 53 may comprise releasable attachment means, such as a snap-in function.

The compartment 24 thus constitutes an external surface of the hull module 20 which may abut the electric power module 50. Preferably, the electric power module 50 is disposed flush with an upper surface of the hull module 20 when the electric power module 50 is received in the hull module 50.

A through-hole 11 in the form of a through hole extends through the hull module 20. Thus, the inner surface of through-hole 11 constitutes an external surface of hull module 20 such that no water is allowed to enter the hull module. According to aspects the hull module is independently waterproof or hermetically sealed. Thus, the hull module 20 may be buoyant regardless its orientation in relation to water.

The through-hole 11 is adapted to receive a connector 35 of a driveline module 30. The driveline module 30 is adapted to be attached to a bottom external surface of the hull module 20. Thus, the entire driveline module 30 is submerged in fluid, such as water, during operation of the watercraft 10. The driveline module and/or the electric power module 50 may comprise power electronics for operating the watercraft. Such power electronics is known in the art and is not the subject of the current disclosure.

The driveline module 30 comprises at least one motor 31 in driving connection with at least one propelling member 32, 139 via at least one drive shaft 33. The motor 31 may be comprised in a motor unit which also may comprise power electronics. The propelling member 32 may for example comprise one or more propellers. The driveline module 30 may comprise casing or pods surrounding the propelling member.

The propelling member 32 and the motor 31 is separated by a spacing or gap having of length λ. The gap may be in the form of a void 52, i.e. a void space between the motor 31 and the impeller 139 or pod 40. The casing 40 and the motor 31 are respectively attached to a hull connection 34 which fixates the positions casing 40 and motor 31 in relation to each other. Thus, the casing 40 and the motor unit 31 are according to aspects not in direct contact with each other.

Figure 2:
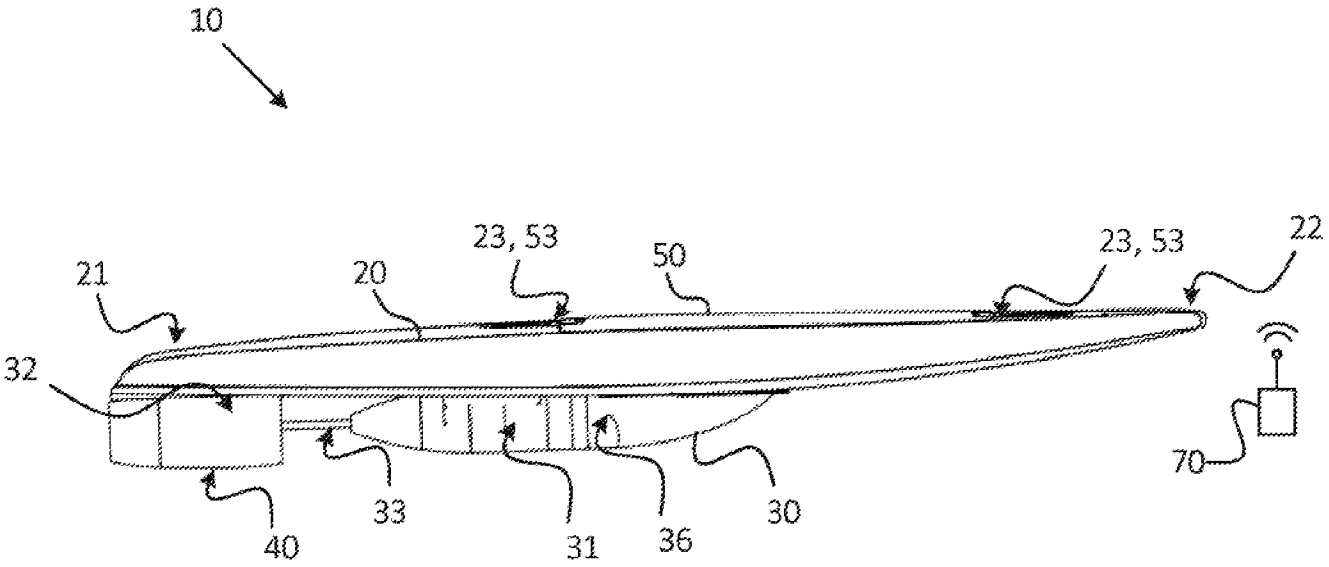
FIG. 2 shows an assembled view of the embodiment of FIG. 1.

FIG. 2 shows the watercraft 10 as described in conjunction with FIG. 1. In FIG. 2 the watercraft is assembled. The driveline module 30 is attached to the bottom of the hull module 20 such that substantially the entire driveline module 30 or the entire driveline module 30 is submerged during operation, i.e. when the watercraft is launched into water.

During operation the water will provide passive water cooling to the driveline module 30 and in particular to the motor 31. However, as the watercraft makes speed over water, the water flowing around the driveline module 30 will provide efficient cooling.

It should be noted that due to the gap 52 of length λ, it is facilitated that the water enters the propelling member 32 at an advantageous angle with respect of the pitch of the propellers of the propelling member, i.e. the blades of the propelling member 32. The water may thus enter the casing 40 and/or the propelling member 32 in a direction substantially parallel the drive axle 33, thereby increasing efficiency and performance of the driveline system 60, i.e. by achieving greater speeds of the watercraft 10. The length of λ may correspond to about 5 to 50% of the length of the driveline module, preferably about 10 to 30%.

The watercraft 10 may be controlled by various means such as a speed control disposed on the electric power module 50 and/or on the driveline module 30. The watercraft 10 may also be controlled via remote control, for example by means of a remote control unit 70.

The watercraft 10 may be suitable for personal transport or leisure. For example, a user may stand on the board or lay down on the board during operation. In a further example the user may lay down on the board and control the watercraft by operating the remote control unit 70.

Figure 3:
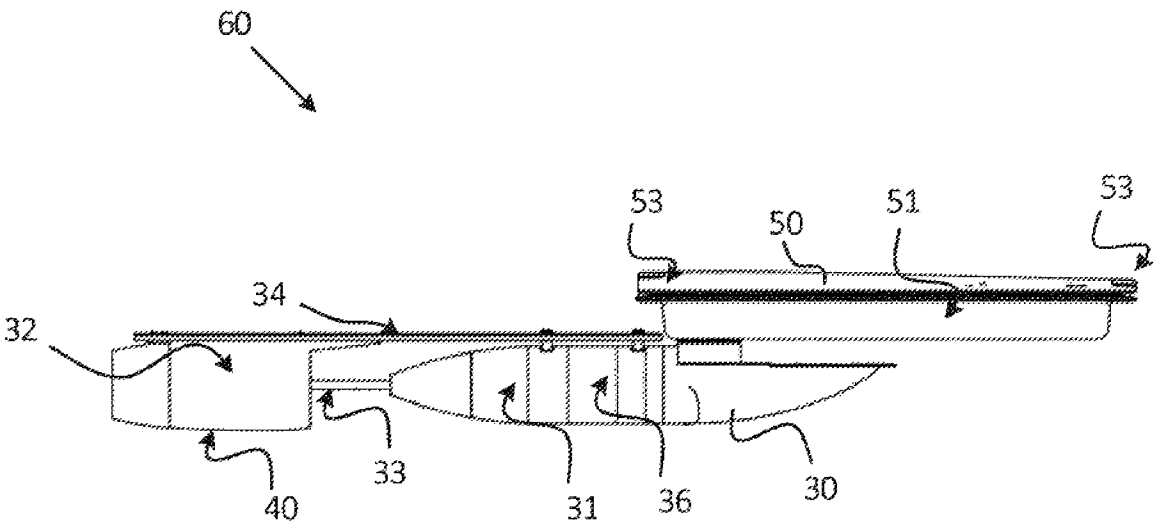
FIG. 3 shows a driveline system according to one embodiment of the invention.

FIG. 3 shows a driveline system 60 formed by the driveline module 30 and the electric power module 50. The driveline system 60 can operate independently the hull module 20. One possible interpretation of the term "operate" is that the driveline system 60 is self-sustained in terms of providing a functioning driveline i.e. comprising power supply in the form of the electric power module 50, power transformation to kinetic energy by means of said motor 31 and propelling force by means of said propelling member 32.

Figure 4:
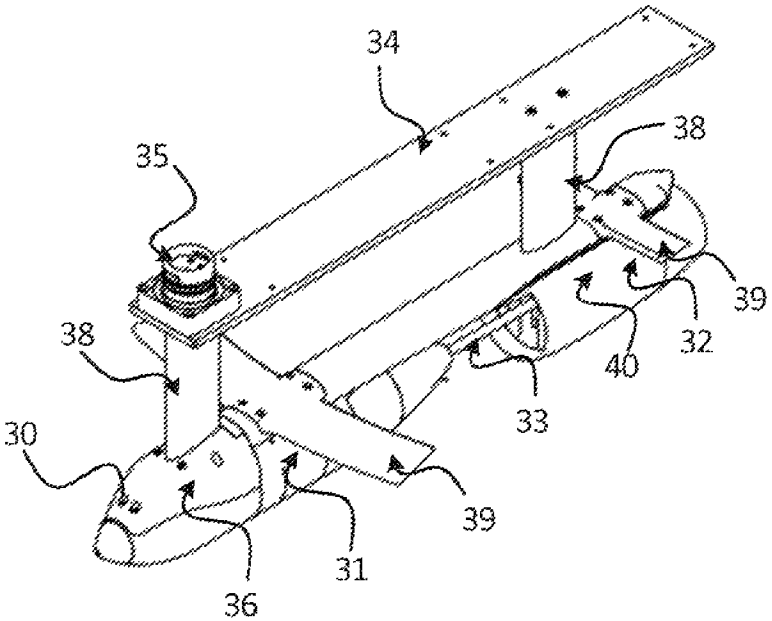
FIG. 4 shows an isometric view of the driveline module according to an embodiment of the invention.

FIG. 4 show a further embodiment of the driveline module invention which unless specified comprise the same features as has been described in relation to FIGS. 1-3.

In the embodiment of FIG. 4 the driveline module comprises struts 38 and hydrofoil-wings 39. The struts 38 and wings 39 facilitates that the watercraft 10 can to some extent lift over the water to enable the watercraft 10 to ride over the water and therefore enable less drag in the water and therefore decreasing the energy-consumption of the watercraft 10 and also increasing the speed of the watercraft 10.

According to one aspect, the invention relates a method of assembling a modular electric motorized watercraft 10. The electric motorized watercraft 10 comprising a hull module, a driveline module and a power source module. The method may comprise the steps of; receiving a requirement relating to a desired functionality of the watercraft; selecting a hull module from the group comprising; hydrofoiling watercraft, surfboard, jetski/water scooter, over water drone, underwater drone, submarine or boat; detachably attaching the driveline module to said hull module; detachably attaching said power source module to said hull module; connecting said power source module to said driveline module. According to aspects of the method, the watercraft 10 consists of the hull module, the electric power module the driveline module.

In a simple form of the invention, the modular electrically motorized watercraft 10 comprises a hull module 20 and a driveline system 60 shown in FIG. 3. The driveline system 60 comprises an electric power module 50 and a driveline module 30. The driveline system 60 is capable of operating independently the hull module 20. Thus, the driveline system 60 is, when assembled, fully water proof. This feature has the advantage that it can operate externally the hull module 20 during operation of the watercraft 10 such that no electrical components, or no components essential for the basic function of the watercraft has to be integrated in the hull module. Thus, the hull module 20 may comprise only a dead shell. The driveline module 30 is adapted to be attached to an underside of the hull module, typically to a bottom external surface of the hull module 20. In particular the motor 31 is arranged underneath the watercraft 10.

The hull module 20 is preferably independently waterproof and may also be independently buoyant, i.e., the hull module may in some embodiments not be buoyant, for example if the watercraft is an underwater craft. Further, the power module 50 and driveline module 30 may each be individually waterproof.

The modules 20, 30, 50 may constitute individual parts. The modules constitute independent sub-assemblies in the form of modules which can be assembled to a fully functional watercraft.

The driveline module 30 and the power module 50 may be fully connected by means of a single connector 35, for example a plug and socket arrangement.

The watercraft 10 may comprise one or more driveline modules 30 connected to the hull module 20.

Substantially the entire driveline module 30 is submerged in a surrounding fluid during operation of the watercraft 10. The driveline module 30 comprises a water jet arrangement 137 comprising at least one impeller in driving connection with a motor 31 of the driveline module 30 via a driving axle 33. The motor 31, the axle 33 and the water jet arrangement 137 are preferably arranged along a straight line. The motor 31 is disposed with an axial distance apart from the propelling member 32. In particular, the motor 31 and the water jet arrangement 137 are preferably entirely submerged during operation of the watercraft 10. However, connecting means, in the form of connector 35 may extend upwards from the driveline module 30 and into the hull module 20, preferably through the hull module 20 via a through hole 11, as will be further explained herein. One possible meaning of the term "through hole" is that it extends through the whole entity, i.e. in this case the whole entity of the hull module 20.

The electric power module 50 and the driveline module 30 are respectively configured to establish electric connection with each other and mechanical connection, preferably releasable mechanical connection with each other.

The electric power module 50 is configured to be attached an external side of the hull module 20 and thus forms an external side of said watercraft 10, typically an upper side of the watercraft 10 and on which surface a user of the watercraft 10 can be positioned.

The electric power module 50 and the driveline module 30 may be detachably attached on opposite sides of said hull module 20. This facilitates that the power module 50 can easily be switched out for another power module for example when the batteries are depleted, and so without pivoting or turning the hull module 20, for example when floating on water, The driveline module 30 comprises at least one motor 31 in driving connection with a respective propelling member 32 by means of a drive axle 33 and preferably the propelling member 32 is disposed at a rear end 21 of the watercraft 10. The propelling member 32 may be an impeller of a water jet arrangement 137, as will be further explained herein.

Figure 5:
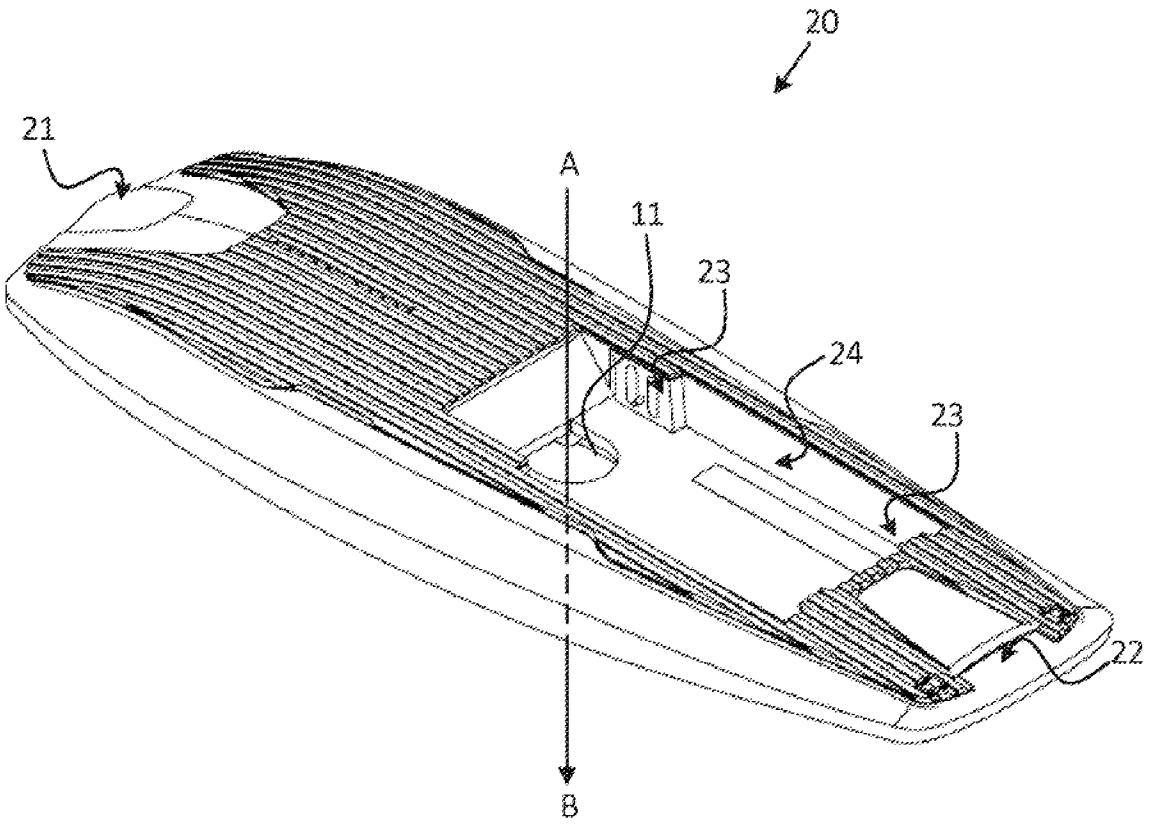
FIG. 5 shows an isometric top view of a hull module according to an embodiment.

As mentioned, the hull module 20 comprises at least one through hole 11 extending through said hull module 20, as derivable inter alia from FIGS. 1 and 5. The through hole 11 may extend from an upper side of said hull module 20 to a lower side of said hull module 20.

This configuration has a number of advantageous effects, as has been made apparent herein. As mentioned, it facilitates that the power module 50 can be switched for a new one without pivoting the hull module 20.

The through hole 11 is adapted to facilitate connection between the power module 50 and the driveline module 30. In some embodiments, the through hole 11 receives the connector 35 of the driveline module 30.

Figure 6:
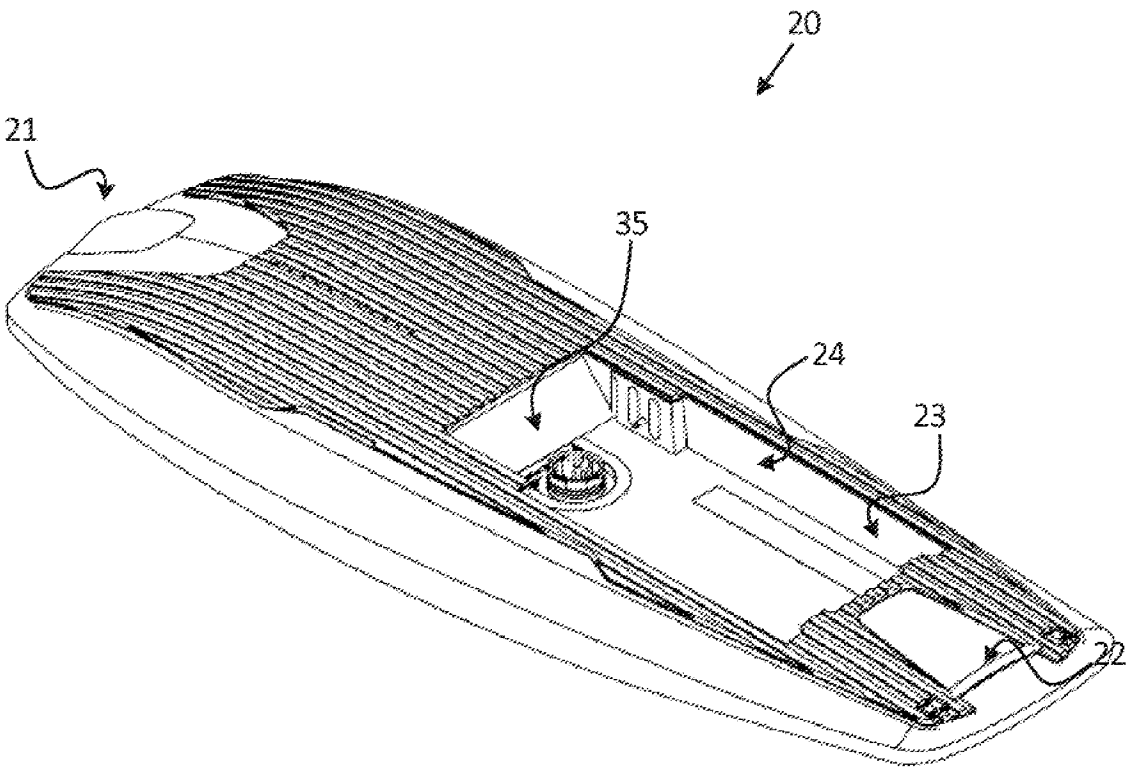
FIG. 6 shows an isometric top view of a hull module according to an embodiment and a thereto assembled driveline module according to an embodiment.

Thus, the through hole 11 provides an opening for mechanical and electrical connection there through, hence between the electric power module 50 and the driveline module 30, this is shown in FIGS. 1 and 6.

Figure 7:
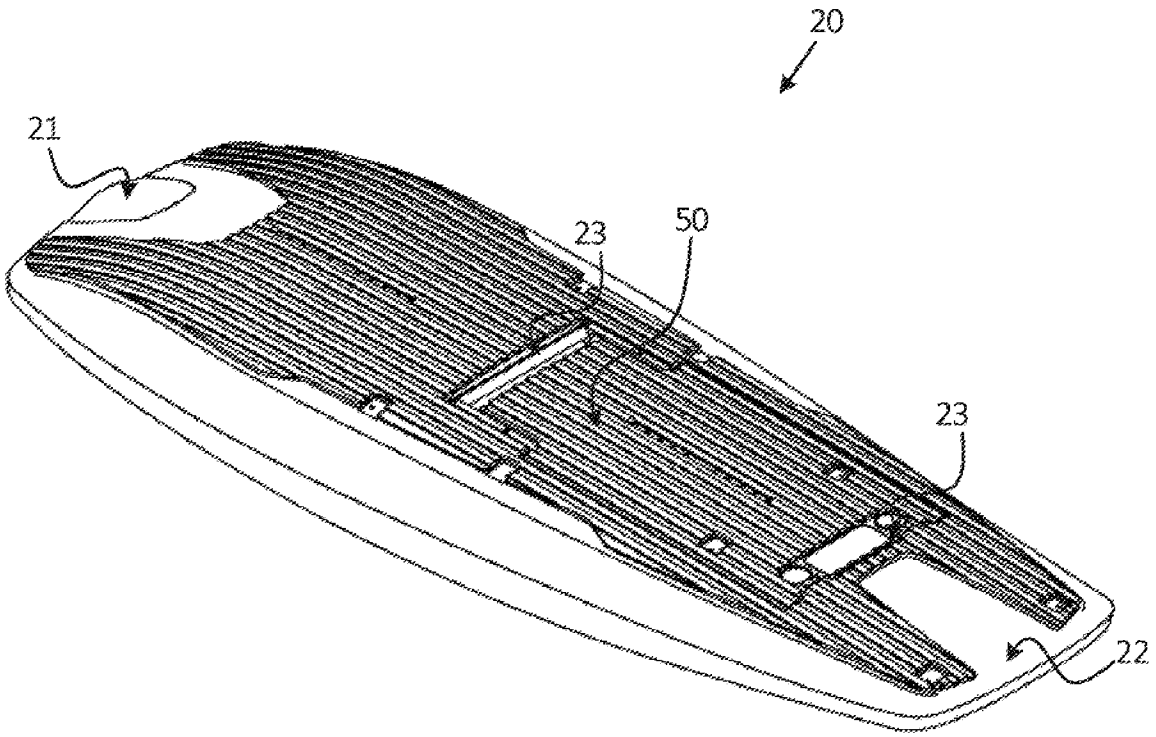
FIG. 7 shows an isometric top view of a hull module according to an embodiment and a thereto assembled power module according to an embodiment.

The hull module 20 is configured to receive the electric power module 50 as shown in FIG. 7. An external side of the hull module 20 may form an open compartment 24 in the form of an open basin 24 configured to receive the electric power module 50, preferably from above the hull module 20. The compartment 24 is illustrated in FIG. 5. The inner walls of the compartment will thus prevent the power module from lateral movements or dislodging.

The driveline module 30 may comprise an electronic speed controller 36 (ESC). In some embodiments, the ESC 36 is disposed in a portion of the driveline module positioned vertically directly underneath the through-hole 11. The said portion of the driveline module 30 may comprise the connector 35. This has the effect that the ESC will be passively cooled by means of water flowing from the through-hole 11 under the action of gravity. This is achieved since the through-hole 11 fluidly connects point A above the hull module 20 with point B below the hull module 20 of the watercraft 10 and also during operation of the watercraft 10. Thus the driveline module 30, and in particular the ESC may be water-cooled passively by means of gravity, e.g. during operation in water. The through hole 11 further facilitates that, when the watercraft is in operation i.e. when a user makes speed over water, water is pushed upwards from beneath the hull module 20, through the trough-hole 11 to the compartment 24, and thereby cools the power module 20.

Further, the power module 50 and the compartment 24 are configured such that there is a slot 37 between the power module 20 and the compartment 24 when the power module 20 is arranged in the compartment 24. Thereby, water from the ambient, e.g. splashing over the hull module 20, is allowed to fill up the compartment 24 via the slot 37 and thus flow around, surround and at least partially submerge the power module 20, providing it with passive cooling.

As explained, the driveline module 30 may comprise hydrofoil wings 39 and struts 38 to enable a foiling ride of said watercraft 10. This is further illustrated in FIG. 6, where an optional foil 39 is shown. The optional foil may be configured to provide a minor lifting power to the watercraft, such as to only raise the nose or front end of the hull module 20 when making speed over water while the water jet arrangement 137 remains completely submerged.

The electric power module 50 and said driveline module 30 connect electrically and mechanically via the through-hole 11. Thus, the electric power module 50 and the driveline module 30 connect electrically and mechanically externally said hull module 20. The through hole 11 is formed removed from the edges of the hull module 20, preferably substantially at a transversally centered position of the hull module 20. Thus, the through hole 11 comprises a circumferential rim and the hull module 20 extends continuously around/about the through-hole 11. The through hole 11 extends from a bottom surface of the hull module 20 to a top surface of the hull module 20. The through hole thereby fluidly connects an upper side to a lower side of the hull module 20 also when the watercraft is assembled.

The electric power module 50 and/or the driveline module 30 may at least partially extend into the through hole 11 as shown in FIGS. 1 and 6. This has the advantage that there are no electrical wires extending between the power module 50 and the driveline module 30 as they connect solely by means of releasable connectors. This has the further advantage that the connector 35 extends above a bottom surface of the compartment 24 as shown in FIG. 6.

The through hole 11 opens to and/or is in communication with the open compartment 24 as shown in FIG. 5. Hence, the compartment 24 opens to the ambient and/or may constitute a depression in the hull module 20 which is open to ambient elements such as water during operation of the watercraft 10.

Each one of the electric power module 50 and/or the driveline module 30 comprises respective electric connection means 35 and releasable mechanical connection means 35 for connecting to each other. Wherein the electric connection means 35 and/or the releasable mechanical connection means 35 is disposed externally the hull module 20.

The electric connection means 35 and/or the releasable mechanical connection means 35 may be disposed in the compartment 24 as in the embodiment illustrated in FIG. 6. The mechanical connection 35 comprises a watertight connection. The mechanical connection means 35 may alternatively comprises a watertight connection disposed immediately adjacent the through hole 11. Alternatively, the electric power module 50 and/or the driveline module 30 at least partially extends into said through-hole 11.

The mechanical connection 35 physically and sealingly connects, releasably locks and holds the electric power module 50 and the driveline module 30 together. The mechanical connection 35 may comprise a releasable snap-in function.

The electric connection means 35 and releasable mechanical connection means 35 comprises a waterproof blind-mate connection 35 configured to connect the power module 50 to the driveline module 30 simultaneously as the power module 50 is received in the compartment 24.

The through hole 11 provides a passage for cooling water through the hull module 20. The compartment 24 is configured to facilitate passive water cooling to the power module 50, in particular when the power module 50 is received in the compartment 24.

The compartment 24 is configured to allow water to flow therein when the power module 50 is received therein to thereby at least partially submerge the power module 50 in cooling water. The water that flow into said compartment 24 is allowed drain through the hull module 20 via the through hole 11. Thus, water accumulated in the compartment is drained under the action of gravity via the through hole 11 to provide passive cooling to the driveline module 30. Hence, the through hole may be arranged to drain cooling water that flow into the compartment through the hull module.

The electronic speed controller 36 may be configured to control the operation of the driveline module. Further, the electronic speed controller 36 may be further configured to control the operation of the motor 31.

In some embodiments, the remote control unit 70 is operatively connected to the electronic speed controller 36 for controlling the watercraft, e.g. the driveline module. In some embodiments, the remote control unit 70 may be operatively connected to the electronic speed controller 36 via a communication unit. The communication unit may be disposed on the power module 50. The communication unit may be powered by means of said power module 50, e.g. the battery of the power module.

In some embodiments, the remote control unit 70 is operatively connected to the electronic speed controller 36 by means of electric wire or cable. In some embodiments, the remote control unit 70 may be connected to the electronic speed controller 36 via the communication unit by means of electric wire or cable. In some embodiments, the communication unit is coupled to the electronic speed controller 36 by means of contact pins.

In some embodiments, the remote control unit 70 is wirelessly connected to the electronic speed controller 36. In some embodiments, the remote control unit 70 is wirelessly connected to the electronic speed controller 36 via the communication device. The communication device may be wirelessly connected to the electronic speed controller 36.

In some embodiments, the watercraft or driveline module may further comprise at least one amplifier, each of which being configured to strengthen the signals between the remote control unit 70 and the communication unit and/or the signals between the remote control unit 70 and the electronic speed controller 36 and/or the signals between the electronic speed controller 36 and the communication unit.

In some embodiments, at least one amplifier for strengthening the signals between the remote control unit 70 and the electronic speed controller 36 and/or the communication unit may be disposed on the external side of the hull module 20 or on the electric power module.

In some embodiments, at least one amplifier for strengthening the signals between electronic speed controller 36 and the remote control unit 70 and/or the communication device may be disposed on the electric power module 50 or the external side of the hull module 20.

Figure 8:
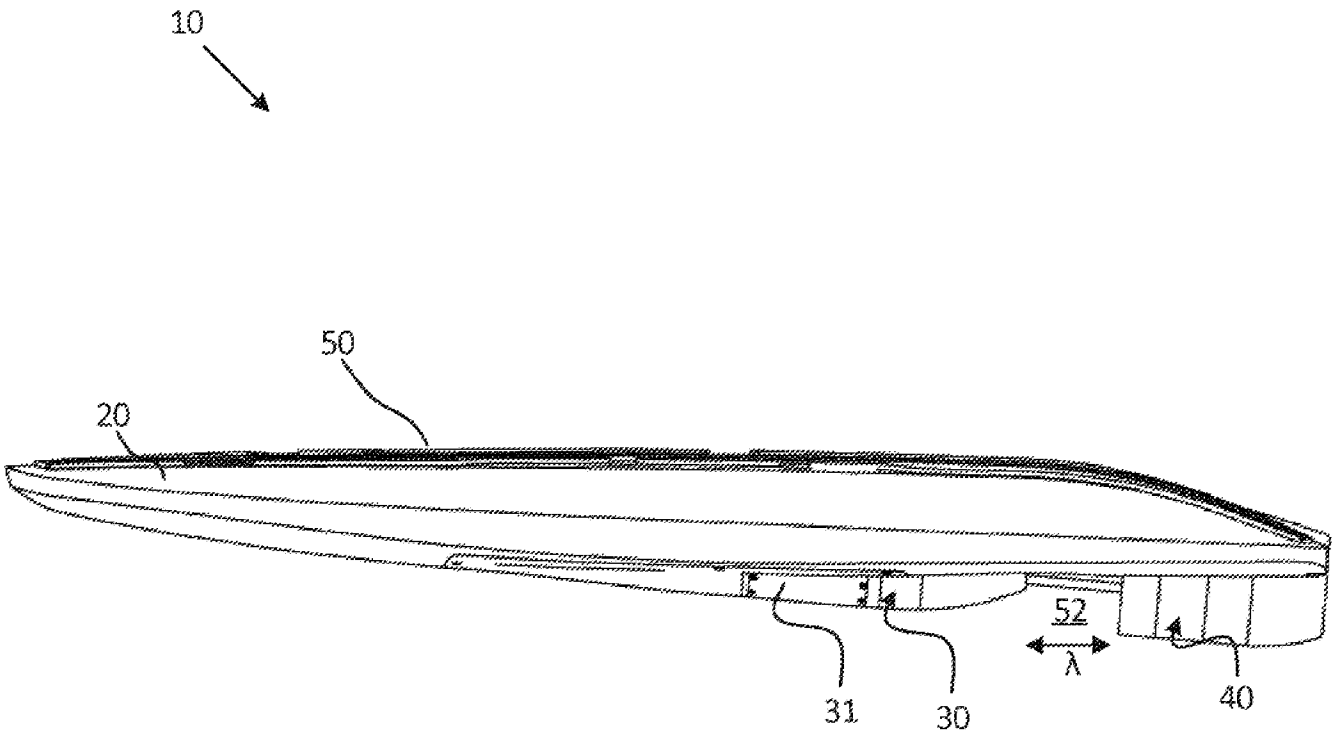
FIG. 8 shows a perspective side view of the watercraft according to an embodiment.
Figure 9:
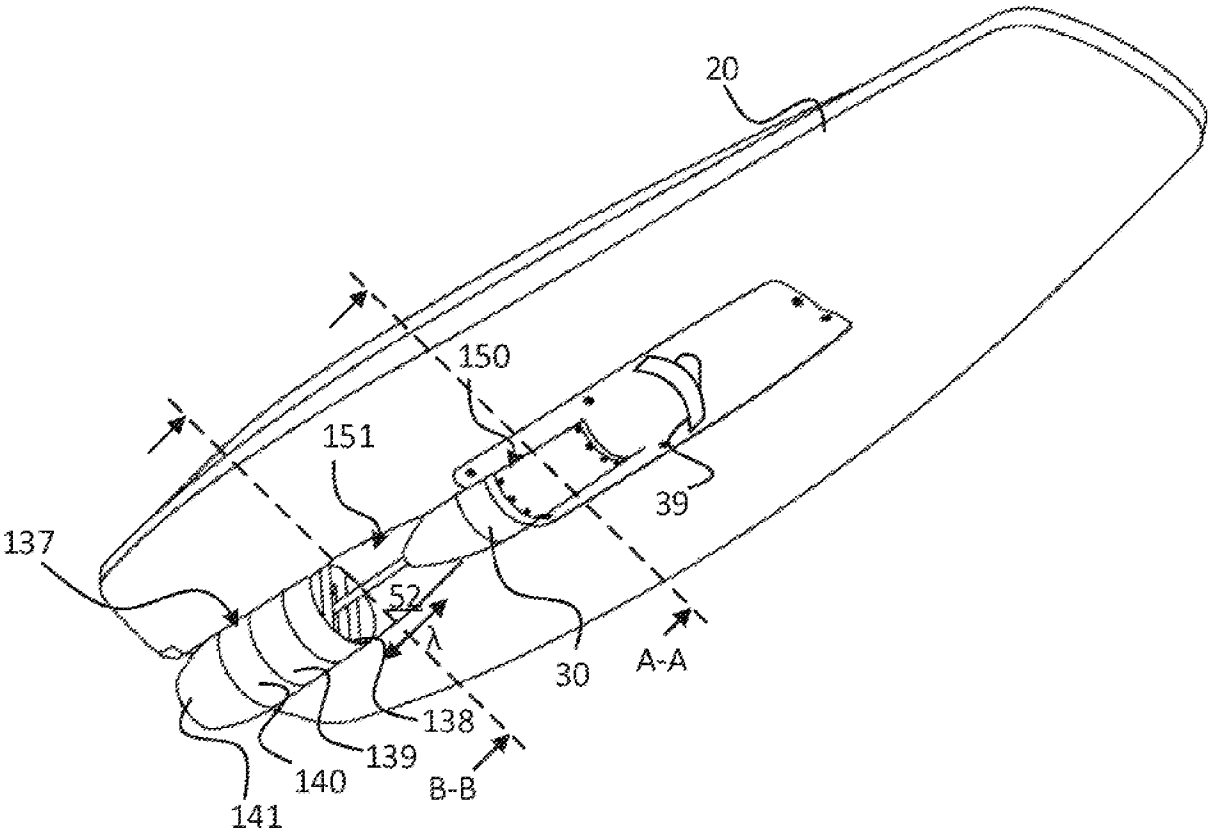
FIG. 9 shows an isometric bottom view of the watercraft according to an embodiment.

Referring in particular to FIGS. 8 to 10, an underside of the hull module 20 may comprise an oblong depression 150 extending in the longitudinal direction of the hull module 20 and configured to receive at least a portion of the driveline module 30. The depression 150 is preferably elongated. The longitudinal axis of the depression 150 is substantially parallel the longitudinal axis of the driveline module 30.

The depression 150 may have a length corresponding to the driveline module 30. The depression 150 brings about the advantageous effect that the hydrodynamic resistance of the watercraft is greatly improved. Also, by arranging the driveline module 30 partially submerged into the hull module 20, i.e. in the depression 150, the maneuverability of the watercraft is improved.

Figure 10A:
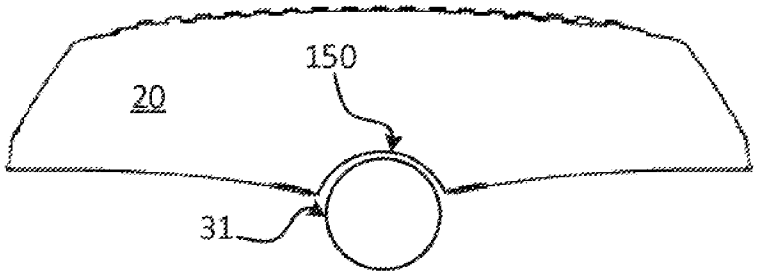
FIG. 10*a* shows a schematic cross-sectional view along the A-A line of FIG. 9.

Referring to FIGS. 9 and 10*a*, the said depression 150 has a cross sectional shape corresponding to a semi-circle or semi-cylindrical shape which envelopes substantially half of a corresponding cylindrical shape of the driveline module 20, in particular the motor 31 (or a motor casing) and the cylindrical casing of the propelling member 32, 139, i.e. the pod 40.

Figure 10B:
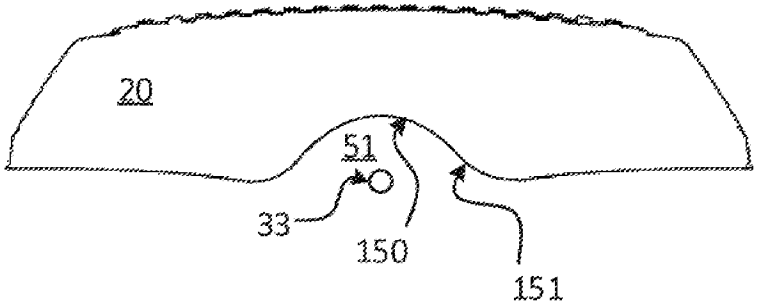
FIG. 10*b* shows a schematic cross-sectional view along the B-B line of FIG. 9.
Figure 11:
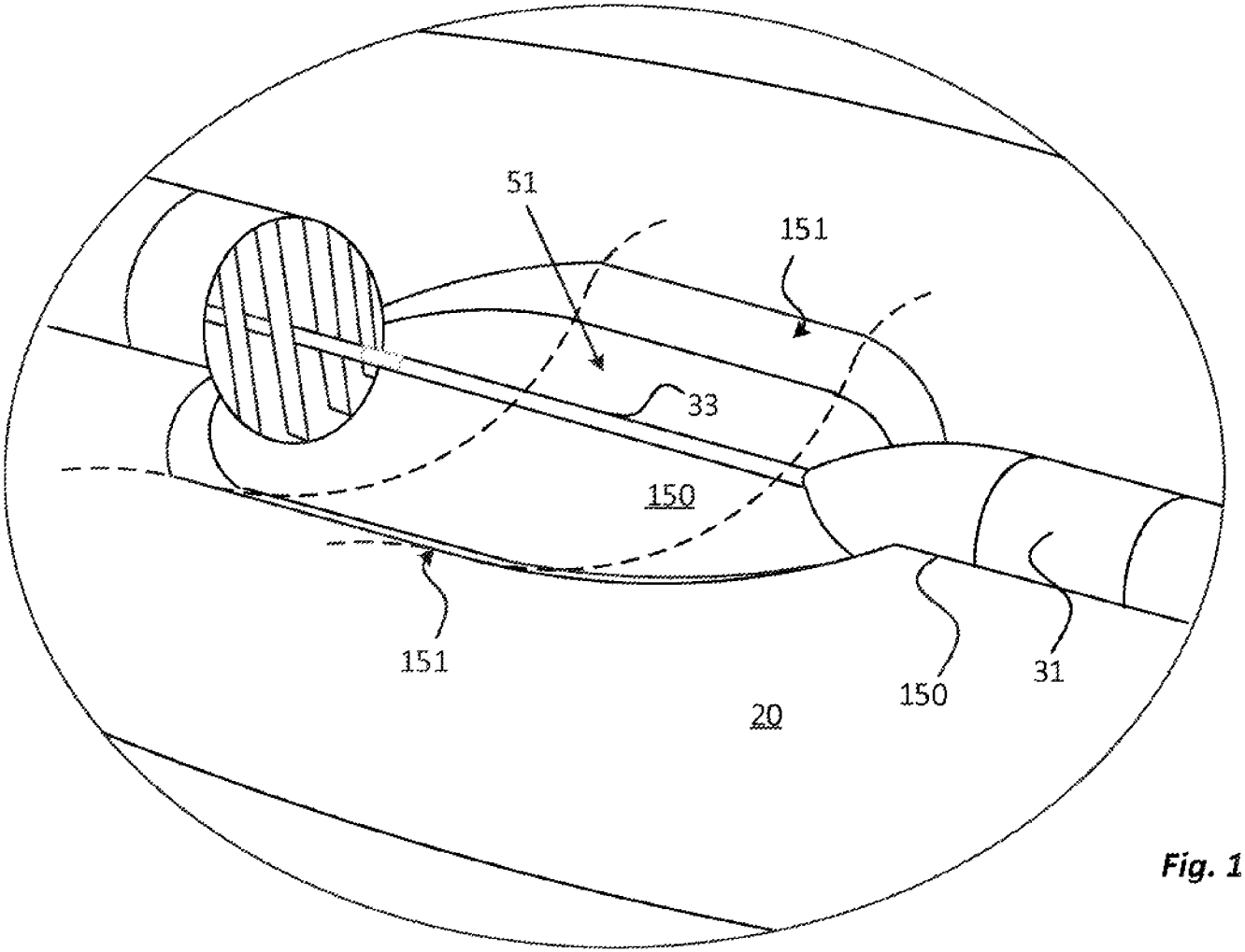
FIG. 11 shows details of the hull module and the driveline module according to embodiments.

The surface of the hull module 20 adjacent a portion of the depression 150 in the immediate vicinity of the gap 52 between the motor 31 and the pod 40 may comprise evened out edges to form a smooth gradual transition 151 between the surface of the hull module 20 and the depression 150. Hence, the width of the depression 150 is substantially wider in the vicinity of the gap 52, as shown in FIGS. 10*b* and 11. The gradual transition 151 between the surface of the hull module 20 and the depression 150 forms a cavity 51 extending around the gap 52, i.e. extends over the vicinity of the drive axle 33. Thereby the axle 33 extend through a void which faces the open water during operation, this facilitates increased water-ingestion of the water jet arrangement 137.

Figure 12A:
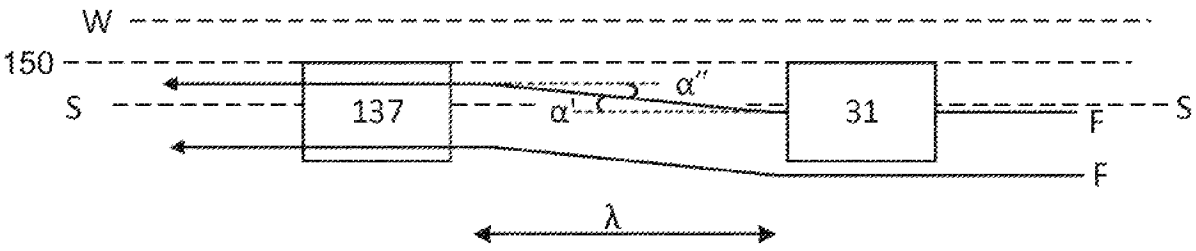
FIG. 12*a* is a schematic illustration of a fluid flow.
Figure 12B:
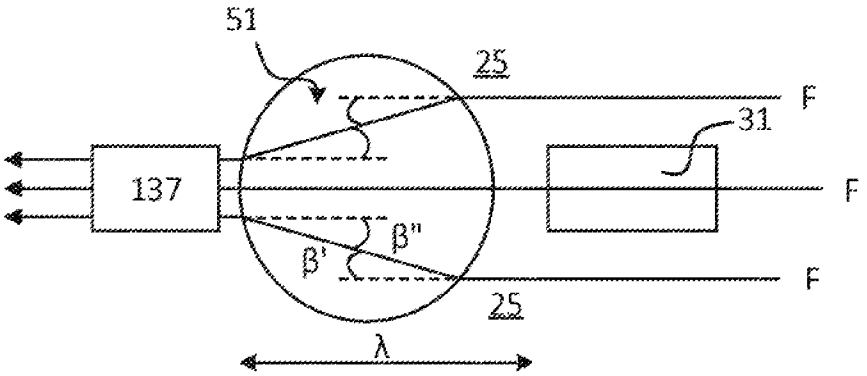
FIG. 12*b* is another schematic illustration of a fluid flow.

Thanks to the gap 52 being configured to cooperate with the cavity 51 by adapting the length λ thereof, the driveline module 30 facilitates improved maneuverability of the watercraft 10 while maintaining a high efficiency of the water jet arrangement and low hydrodynamic losses. FIG. 12*a* is a schematic side-view of how the configuration of the gap 52 achieves that the angles of deflection/diversion α', α" of a fluid flow F to be ingested is minimized along the driveline module 30. Also shown in FIG. 12*a* is the waterline W of the watercraft 10, the depression 150 and the bottom surface S of the hull module 20. As derivable, the fluid flow F, i.e. water to be ingested is provided a sufficient distance to flow into the cavity 51 by means of a small angle of diversion α' relative to the bottom surface of the hull module 20 and subsequently provided sufficient distance to attain a flow direction parallel the drive axle 33 (not shown in FIG. 12*a*) by means of a small angle of diversion α". Thus, the angles of deflection α' and α" are minimized by providing the gap 52 with the length λ between the impeller 139 and the motor 31, while still the motor 31 and the water-jet arrangement 137 are both submerged and coaxially arranged in the hull module 20. This principle also applies for water flowing into the open cavity 51 from the vicinity of the cavity 51, for example from the flanks 25 on each side of the open cavity 51 as shown in FIG. 12*b*; the gap 52 with the length λ and the gradual transition 151 facilitates hydrodynamically advantageous flow path which minimizes the angles of diversion β' and β" and thus energy losses of water flowing into the cavity 51 from the vicinity of the cavity 51, for example from the flanks 25 on each side of the cavity 51.

The watercraft 10 may be a hydrofoiling watercraft, a surfboard, jetski/water scooter, over water drone, underwater drone, underwater craft, underwater personal craft, submarine, boat.

In general, the modules 20, 30, 50 are independent sub-assemblies and may thus comprise independent parts. In particular one or more of the modules 30 and 50 may be independent sub-assemblies arranged in a single housing, whereby the connector 35 is integrated or extends from the housing.

The hull module 20 does not have any waterproof compartments for electronics, motors, gasoline or similar since all necessary electrical components are integrated in the driveline system 60. Also, no electrical parts are integrated in the hull module. The power module 50 may comprise one or more of battery cells, a computer, battery management system, switches.

The motor 31 is typically installed in a waterproof container or casing of the driveline module 30.

An external surface, preferably an upper surface of the hull module 20 comprises a shelf-like compartment 24 configured to receive and retain the electric power module 50.

An inner surface of the through-hole 11 constitutes an external surface of the hull module 20 such that no water is allowed to enter the hull module 20. The through-hole 11 penetrates the entire hull module 20, thus the through-hole 11 allows immediate access to the underside of the hull module 20 from the upper side of the hull module 20 via the through hole 11.

The through-hole 11 is adapted to receive a connector 35 of the driveline module 30. The through hole 11 preferably has a diameter sized to form a circumferential slot about the connector 35. A fluid passage between the inner circumference of the through hole and the connector 35.

The water jet arrangement 137 of the driveline module 30 comprises a casing or pod surrounding the propelling member 32. The casing 40 and the motor unit 31 are not in direct contact with each other. The motor 31 and the propelling member 32 are separated by a gap 52 having the length λ. λ may be in the range of 10 to 30% of the length of the driveline module 20, preferably between 10 to 20%.

The depression 150 may extend along approximately between 20 to 40% of the length of the hull module 20, preferably about 33%.

The casing or pod 40 and the motor 31 are respectively attached to a hull connection 34 which fixates the positions of the pod 40 and the motor 31.

Figure 13:
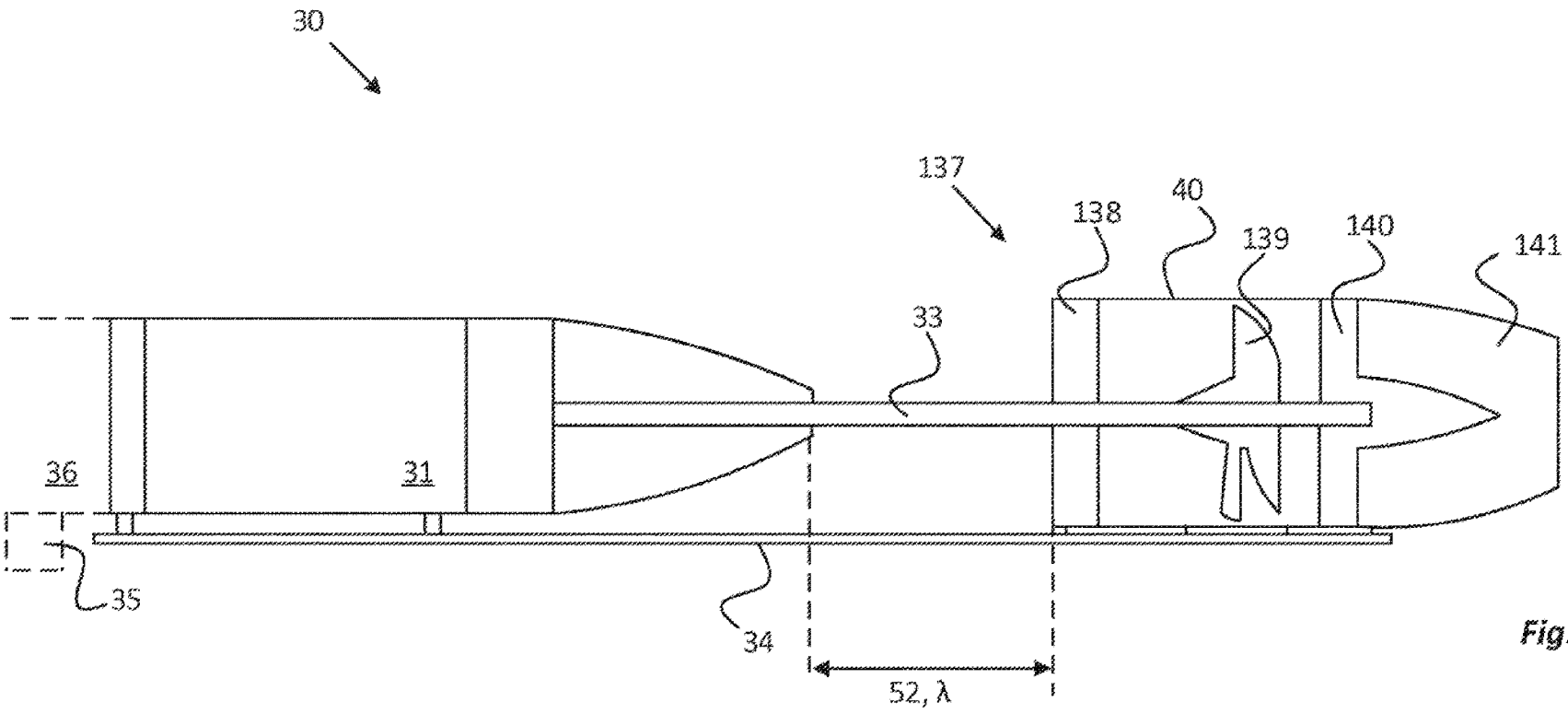
FIG. 13 shows a schematic illustration of a water-jet arrangement according to an embodiment.

Now referring to FIGS. 9 and 13, the propelling member 32 may be an impeller 139 disposed in the pod 40. The pod 40 comprises a stator 140 downstream the impeller 32. The pod 40 also comprises a nozzle portion 141 downstream of the stator 140. Optionally, the pod 40 also comprises inlet guide vanes 138 configured to protect the impeller 139 and to facilitate that a flow of water into the pod 40 is directed in the direction of the longitudinal extension of the pod 40. The stator 140 facilitates reduced turbulence aft/downstream of the impeller 139 and thus increases the efficiency of the driveline module 20. Further, the stator also facilitates that the water jet created by the water jet arrangement 137 is straightened, i.e. directed in a longitudinal direction of the water jet arrangement 137. The nozzle portion 141 of the pod 40 comprises a section with decreasing inner diameter of the pod 40, and thus facilitates an increase in the velocity of the exiting water jet at an exit of the nozzle portion 141. The pod 40, the stator 140 and optionally the inlet guide vanes 138 are made or provided as one entity or as an assembly. The diameter of the pod 40 is preferably greater than the diameter of the motor casing.

The connector means 35 of said driveline module 30 may be received in the power module 50, as derivable from FIGS. 1 and 6.

The driveline system 60, also referred to as the propulsion system, comprises the power module 50 and the driveline module 30. The driveline module 30 is configured to be mounted to an underside of a hull module 20 of said watercraft. The driveline system 60 is independently waterproof and capable of operating independently the hull module 20. Hence, the power module 50 and driveline module 30 work together externally the hull module 20.

In a preferred embodiment, the driveline system comprises the electronic speed controller (ESC) 36 arranged surrounded by water to provide the ESC 36 with passive cooling from the surrounding water in which it is submerged during operation.

I should be appreciated that embodiments of the disclosure are generally combinable unless specified.

What is claimed is:

1. A modular electrically motorized watercraft comprising:

a hull module; and a driveline system having an electric power module and a driveline module, wherein the driveline module is configured to be arranged at an underside of the hull module; and wherein the hull module, the electric power module, and the driveline module constitute independent sub-assemblies in the form of modules which can be assembled to form the watercraft;

wherein the hull module includes at least one through-hole extending through the hull module;

wherein the through-hole fluidly connects an upper side with a lower side of the watercraft; and wherein the through-hole provides a passage for water through the hull module such that the driveline module is water cooled passively during operation in water.

2. The watercraft according to claim 1, wherein the driveline system is configured to operate independent of the hull module.

3. The watercraft according to claim 1, wherein the driveline module and the electric power module operate externally to the hull module during operation of the watercraft.

4. The watercraft according to claim 1, wherein the electric power module and the driveline module are detachably attached on opposite sides of the hull module.

5. The watercraft according to claim 1, wherein the through-hole extends from an upper surface of the hull module to a bottom surface of the hull module.

6. The watercraft according to claim 1, wherein the through-hole provides an opening for mechanical and electrical connection there through between the electric power module and the driveline module.

7. The watercraft according to claim 1, wherein an external side of the hull module forms an open compartment configured to receive the electric power module.

8. The watercraft according to claim 7, wherein the through-hole is in fluid communication with the open compartment.

9. The watercraft according to claim 7, wherein the compartment is configured to allow water to flow therein when the electric power module is arranged in the open compartment to thereby enable the electric power module to become at least partially submerged in water.

10. The watercraft according to claim 9, wherein water that flows into the open compartment is allowed drain through the hull module via the through-hole.

11. The watercraft according to claim 1, wherein an underside of the hull module comprises an elongated recess or depression extending in the longitudinal direction of the hull module and configured to receive the driveline module.

12. The watercraft according to claim 1, wherein the watercraft is a hydrofoiling watercraft, a motorized surfboard, a motorized wake board, a jetski/water scooter, an over water drone, an underwater drone, an underwater craft, an underwater personal craft, a submarine, or a boat.

13. The watercraft according to claim 1, wherein the driveline module comprises an electronic speed controller.

14. The watercraft according to claim 13, wherein the electronic speed controller is arranged to be surrounded by water to provide the electronic speed controller with passive cooling from the surrounding water in which it is submerged during operation.

15. The watercraft according to claim 1, wherein the driveline module is attached to a bottom of the hull module such that substantially the entire driveline module or the entire driveline module is submerged during operation and the water will provide passive cooling to the driveline module.

16. The watercraft according to claim 1, wherein the driveline module comprises an electronic speed controller; and wherein the electronic speed controller is disposed in a portion of the driveline module positioned vertically directly underneath the through-hole.

17. The watercraft according to claim 1, wherein the driveline module comprises at least one motor in driving connection with at least one propelling member, wherein the water provides passive water cooling to the at least one motor during operation.

* * * * *